US006794967B1

(12) United States Patent
Park

(10) Patent No.: US 6,794,967 B1
(45) Date of Patent: Sep. 21, 2004

(54) ELECTROMAGNETIC SWITCH DEVICE

(75) Inventor: Young Seo Park, Pusan (KR)

(73) Assignee: Shin Dong-A Electric Corp., Pusan (KR)

( * ) Notice: Subject to any disclaimer, the term of this patent is extended or adjusted under 35 U.S.C. 154(b) by 0 days.

(21) Appl. No.: 10/019,830

(22) PCT Filed: Jan. 2, 2000

(86) PCT No.: PCT/KR00/00039

§ 371 (c)(1),
(2), (4) Date: Nov. 7, 2001

(87) PCT Pub. No.: WO00/68965

PCT Pub. Date: Nov. 16, 2000

(30) Foreign Application Priority Data

May 11, 1999 (KR) ..... 1999-16761

(51) Int. Cl.[7] ..... H01H 9/00
(52) U.S. Cl. ..... 335/159; 200/50.01; 335/132
(58) Field of Search ..... 335/159–161, 335/132, 202; 318/727, 752; 200/50.01–50.02

(56) References Cited

U.S. PATENT DOCUMENTS 4,994,725 A * 2/1991 Gschlossl ..... 318/727
5,289,146 A * 2/1994 Plumeret et al. ..... 335/160

FOREIGN PATENT DOCUMENTS

JP 01-286785 A 11/1989
JP 10-271863 A 10/1998
KR 1987-015519 U 10/1987
KR 1989-07818 U 5/1989
KR 1992-013872 A 7/1992
KR 1995-025850 U 9/1995
KR 1998-014546 U 6/1998

* cited by examiner

*Primary Examiner*—Lincoln Donovan
(74) *Attorney, Agent, or Firm*—Snell & Wilmer L.L.P.

(57) ABSTRACT

Disclosed is an electromagnetic switch device for star-delta connections including a body, three power terminals respectively connected to three-phase power lines at one side of the body, three main starting terminals respectively connected to one-side terminals of a three-phase electric motor at the other side of the body, three star-delta terminals respectively connected to the other-side ends of the three-phase electric motor at the other side of the body, an electromagnet for a main circuit and an electromagnet for star-delta connections disposed at a lower portion of the body in such a fashion that they are laterally aligned with each other, each of the electromagnets including a fixed core and a coil wound around the fixed core, a main circuit switching unit serving to selectively connect each of the main starting terminals to an associated one of the power terminals in accordance with a magnetization of the main circuit-end electromagnet, and a star-delta connection switching unit serving to selectively connect the star-delta terminals to one another or to the main starting terminals, respectively, in accordance with a magnetization of the star-delta connection-end electromagnet.

3 Claims, 5 Drawing Sheets

ELECTROMAGNETIC SWITCH DEVICE

TECHNICAL FIELD

The present invention relates to a magnetic contactor (electromagnetic switch device) for star-delta connections, and more particularly to an electromagnetic switch device designed to be used for a star-delta starter adapted to start up a three-phase electric motor in order to allow the motor to be driven at its full speed within a short period of time.

BACKGROUND ART

As well known, star (Y)-delta (Δ) starters, which are used to start up an electric motor, serve to establish a star connection for the electric motor upon the start-up of the electric motor, thereby reducing starting current and starting torque required in the start-up of the electric motor to a ⅓ level, while switching the connection for the electric motor into a delta connection after completion of the-start-up of the electric motor so that the electric motor is driven-in the delta connection state. Such star-delta starters are widely used in a variety of industrial fields in order to protect electric motors and peripheral devices thereof from overload.

Star-delta starters are classified into a contact type using an electromagnetic switch device adapted to switch electric contacts by use of electromagnets, and a non-contact type using a semiconductor switch device. The type using an electromagnetic switch device is more widely used.

FIGS. 1*a*, 1*b* and 2 illustrate a conventional electromagnetic switch device and a star-delta starter using the electromagnetic switch device, respectively. FIG. 1*a* is a perspective view illustrating the electromagnetic switch device, and FIG. 1*b* is a cross-sectional view taken along the line A—A of FIG. 1*a*. FIG. 2 is an equivalent circuit diagram illustrating the star-delta starter.

As shown in FIGS. 1*a* and 1*b*, the conventional electromagnetic switch device, which is denoted by the reference character C, includes a body 1, and a cover 2 separably attached to an upper surface 1*a* of the body 1. Three pairs of terminals 3 are disposed on the upper surface 1*a* of the body 1 in such a fashion that the terminals of each terminal pair are arranged at opposite sides of the body 1, respectively, while being insulated from one another. Electric power lines not shown are connected to the terminals 3, respectively. Isolating plates 4 are arranged at opposite sides of the cover 2 to isolate adjacent ones of the terminals 3.

Three pairs of fixed contacts 5 are also provided. Each fixed contact 5 is arranged at an end of an associated one of the terminals 3 extending toward a central portion of the body 1. The fixed contacts 5 are insulated from one another. A vertical moving member 6 is arranged at the central portion of the body 1 in such a fashion that it is upwardly and downwardly movable. Three pairs of moving contacts 7 insulated from one another are mounted to the vertical moving member 6 at opposite sides of the vertical moving member 6 in such a fashion that each of the, moving contacts 7 selectively comes into contact with an associated one of the fixed contacts 5 so that it is short-circuited or opened with respect to the associated fixed contact 5. A compression coil spring 8 is arranged around the vertical moving member 6 between the upper surface 1*a* of the body 1 and the moving contacts 7 in such a fashion that it always urges the vertical moving member 6 upwardly.

A fixed core 9 is arranged at a lower portion of the body 1. A coil 10 is wound around the fixed core 9 in order to form an electromagnet. Above the fixed core 9, a moving core 11 is arranged in such a fashion that it moves vertically along with the vertical moving member 6 in accordance with a magnetization of the electromagnet.

The conventional star-delta starter using electromagnetic switch devices having the above mentioned configuration includes an electromagnetic switch device C1 for a main circuit, an electromagnetic switch device C2 for a star circuit, and an electromagnetic switch device C3 for a delta connection, which are connected together as shown in the equivalent circuit diagram, of FIG. 2 and activated by a timer (not shown) to start up a three-phase electric motor M.

When current flows through the coil 10 of the electromagnetic switch device C2 for the star circuit upon starting the three-phase electric motor M, the electromagnet formed by the fixed core 9 and coil 10 is magnetized by virtue of the current.

Accordingly, the electromagnet generates a magnetic force greater than the resilience of the spring 8, so that the vertical moving member 6 and moving core 11 are downwardly moved. As a result, the moving contacts 7, which also move downwardly, come into contact with the fixed contacts 5, respectively.

When the electromagnetic switch device C1 for the main circuit is activated in accordance with the same procedure as mentioned above, a star connection is established for the three-phase electric motor M, so that the three-phase electric motor is started up using starting current and starting torque reduced to a ⅓ level. At the same time, the timer not shown begins to operate in order to count the drive time of the three-phase electric motor M.

After a predetermined period of time elapses, the current flowing through the coil 10 of the electromagnetic switch device C2 for the star connection is cut off by an operation of the timer. At the same time, current flows through the coil 10 of the electromagnetic switch device C3 for the delta connection.

In this state, the magnetic force of the electromagnet formed by the fixed core 9 and coil 10 of the electromagnetic switch device C2 for the star connection disappears. As a result, the vertical moving member 6 is upwardly moved along with the moving core 11 and moving contacts 7 by virtue of the resilience of the spring 8, thereby causing the moving contacts 7 to be separated from the fixed contacts 5.

Meanwhile, the electromagnet formed by the fixed core 9 and coil 10 of the electromagnetic switch device C3 for the delta connection is magnetized by virtue of the current flowing through the coil 10. As a result, the moving contacts 7 are downwardly moved, so that they come into contact with the fixed contacts 5, respectively.

Accordingly, the electromagnetic switch device C3 for the delta connection is short-circuited to electric power lines at its one-side terminals 3. As a result, the three-phase electric motor M is switched to the star connection state to a delta connection state, so that it is driven at a full speed.

In the star-delta starter having the above mentioned configuration, each of its electromagnetic switch devices is used only for a single purpose, that is, a star connection or a delta connection. For this reason, the conventional star-delta starter cannot implement a desired system unless at least two electromagnetic switch devices are used, even when those used for the main circuit are not taken into consideration.

As a result, the conventional star-delta starter involves high-manufacturing and installing costs and a large occupation space.

The conventional star-delta starter also involves a complex wiring for the connection between the electric motor and the electromagnetic switch device used. Such a complex wiring may result in a possibility of erroneous connections. In particular, such a wiring may be easily damaged by an external force applied thereto, thereby resulting in an erroneous operation of the starter or a damage of the electric motor.

DISCLOSURE OF INVENTION

Therefore, an object of the invention is to solve the above mentioned problems involved in the prior art, and to provide an electromagnetic switch device for star-delta connections which includes two electromagnets arranged in its body and two switching units operating in accordance with respective magnetization states of the electromagnets in order to selectively establish a star connection or a delta connection for a three-phase electric motor, so that it can reduce installation costs and an occupation space when it is applied to a star-delta starter while using no unnecessary wiring, thereby reducing erroneous connections and erroneous operations.

In accordance with the present invention, this object is accomplished by providing an electromagnetic switch device for star-delta connections comprising: a body; three power terminals arranged at one side of the body and respectively connected to three-phase power lines, the power terminals being insulated from one another; three main starting terminals arranged at the other side of the body and respectively connected to one-side terminals of a three-phase electric motor, the main starting terminals being insulated from one another; three star-delta terminals arranged at the other side of the body outside the main starting terminals and connected to the other-side ends of the three-phase electric motor, respectively, the star-delta terminals being insulated from one another; an electromagnet for a main circuit and an electromagnet for star-delta connections disposed at a lower portion of the body in such a fashion that they are laterally aligned with each other while being insulated from each other, each of the electromagnets including a fixed core and a coil wound around the fixed core; a main circuit switching unit arranged near the main circuit-end electromagnet in the interior of the body, the main circuit switching unit serving to selectively connect each of the main starting terminals to an associated one of the power terminals in accordance with a magnetization of the main circuit-end electromagnet; and a star-delta connection switching unit arranged near the star-delta connection-end electromagnet in the interior of the body, the star-delta connection switching unit serving to selectively connect the star-delta terminals to one another or to the main starting terminals, respectively, in accordance with a magnetization of the star-delta connection-end electromagnet.

Preferably, the electromagnetic switch device further comprises a timer arranged in the interior of the body and adapted to count an activation time of the main circuit-end electromagnet, thereby determining a point of time when the star-delta connection-end electromagnet is to be activated.

The electromagnetic switch device may further comprise isolating plates arranged between adjacent ones of the power terminals, between adjacent ones of the main starting terminals, and between adjacent ones of the star-delta terminals to isolate the adjacent power terminals, the adjacent main starting terminals, and the adjacent star-delta terminals, respectively.

The main circuit switching unit may comprise: a moving core vertically movable in accordance with a magnetization of the main circuit-end electromagnet; a vertical moving member integrally coupled to the moving core in such a fashion that it is moved along with the moving core; three pairs of fixed contacts arranged at desired positions within a vertical movement zone of the vertical moving member in such a fashion that the fixed contacts included in each of the fixed contact pairs are disposed at opposite sides of the vertical moving member, respectively, the fixed contacts arranged at one side of the vertical moving member being connected to the power terminals, respectively, while being insulated from one another, and the fixed contacts arranged at the other side of the vertical moving member being connected to the main starting terminals, respectively, while being insulated from one another; and three pairs of moving contacts mounted to the vertical moving member in such a fashion that the moving contacts included in each of the moving contact pairs are disposed at opposite sides of the vertical moving member, respectively, the moving contacts arranged at one side of the vertical moving member being insulated from one another, the moving contacts arranged at the other side of the vertical moving member being insulated from one another, and the moving contacts being vertically moved in accordance with a vertical movement of the vertical moving member, so that they selectively come into contact with respective associated ones of the fixed contacts, thereby causing the power terminal-end fixed contacts to be selectively connected to the starting terminal-end fixed contacts.

The star-delta connection switching unit may comprise: a moving core vertically movable in accordance with a magnetization of the star-delta connection-end electromagnet; a vertical moving member integrally coupled to the moving core in such a fashion that it is moved along with the moving core; three pairs of fixed contacts for star-delta connection arranged at desired positions within a vertical movement zone of the vertical moving member in such a fashion that the fixed contacts included in each of the fixed contact pairs are disposed at opposite sides of the vertical moving member, respectively, the fixed contacts arranged at one side of the vertical moving member being connected to the main starting terminals, respectively, while being insulated from one another, and the fixed contacts arranged at the other side of the vertical moving member being connected to the star-delta terminals, respectively, while being insulated from one another; three pairs of moving contacts for delta connection mounted to the vertical moving member in such a fashion that the moving contacts included in each of the moving contact pairs are disposed at opposite Sides of the vertical moving member, respectively, the moving contacts arranged at one side of the vertical moving member being insulated from one another, the moving contacts arranged at the other side of the vertical moving member being insulated from one another, and the moving contacts being vertically moved in accordance with a vertical movement of the vertical moving member, so that they selectively come into contact with respective associated ones of the fixed contacts, thereby causing the star-delta connection-end fixed contacts to be selectively connected to the starting terminal-end fixed contacts so as to achieve a delta connection; and three moving contacts for star connection mounted to the vertical moving member at a position vertically shifted from the delta connection-end moving contacts near the star-delta connection-end fixed contacts, the star connection-end moving contacts being short-circuited together, and the star connection-end moving contacts being vertically moved in accordance with a vertical movement of the vertical moving member, so that they selectively come into contact with respective associated ones of the fixed contacts, thereby causing the fixed contacts to be selectively connected together so as to achieve a star connection, the star connection by the star connection-end moving contacts being achieved when the delta connection by the delta connection-end moving contacts is released.

Each of the main circuit switching unit and star-delta connection switching unit may further comprise a return springs adapted to provide a return force for returning the associated vertical moving member to an original position thereof at which the associated moving contacts are separated from respective associated ones of the fixed contacts.

Each of the main circuit switching unit and star-delta connection switching unit may further comprise an arc prevention spring arranged in the associated vertical moving member and adapted to always urge the associated moving contacts toward the associated fixed contacts, thereby increasing the contact force of the moving contacts when the moving contacts come into contact with the fixed contacts, so as to suppress generation of arc at regions where the moving contacts come into contact with the fixed contacts, respectively.

BRIEF DESCRIPTION OF DRAWINGS

The above objects, and other features and advantages of the present invention will become more apparent after a reading of the following detailed description when taken in conjunction with the drawings, in which:

FIGS. 1*a*, 1*b* and 2 illustrate a conventional electromagnetic switch device and a star-delta starter using the electromagnetic switch device, respectively, wherein FIG. 1*a* is a perspective view illustrating the electromagnetic switch device, FIG. 1*b* is a cross-sectional view taken along the line A—A of FIG. 1*a*, and FIG. 2 is an equivalent circuit diagram illustrating the star-delta starter; and FIGS. 3*a*, 3*b* and 4 illustrate an electromagnetic switch device according to the present invention and a star-delta starter u usithe electromagnetic switch device, respectively, wherein FIG. 3*a* is a perspective view illustrating the electromagnetic switch device, FIG. 3*b* is a cross-sectional view taken along the line A—A of FIG. 3*a*, and FIG. 4 is an equivalent circuit diagram illustrating the star-delta starter using the electromagnetic switch device according to the present invention.

BEST MODE FOR CARRYING OUT THE INVENTION

Figure 1A:
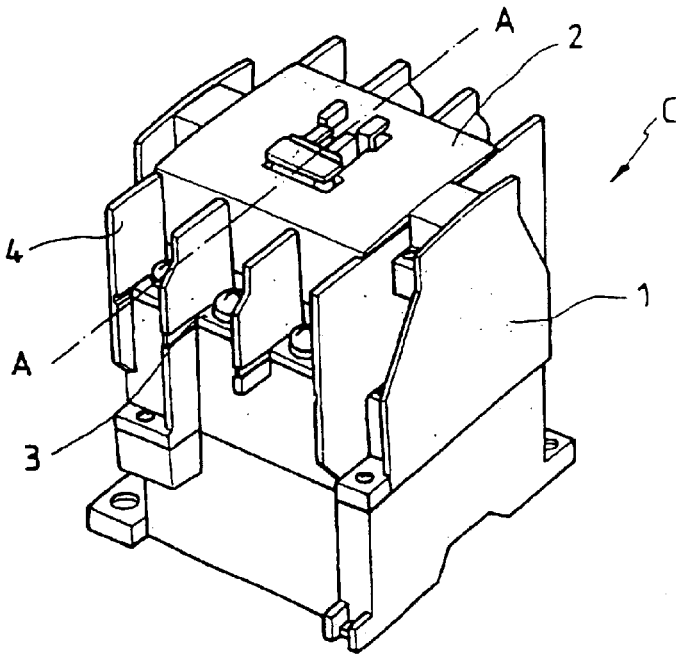
Figure 1B:
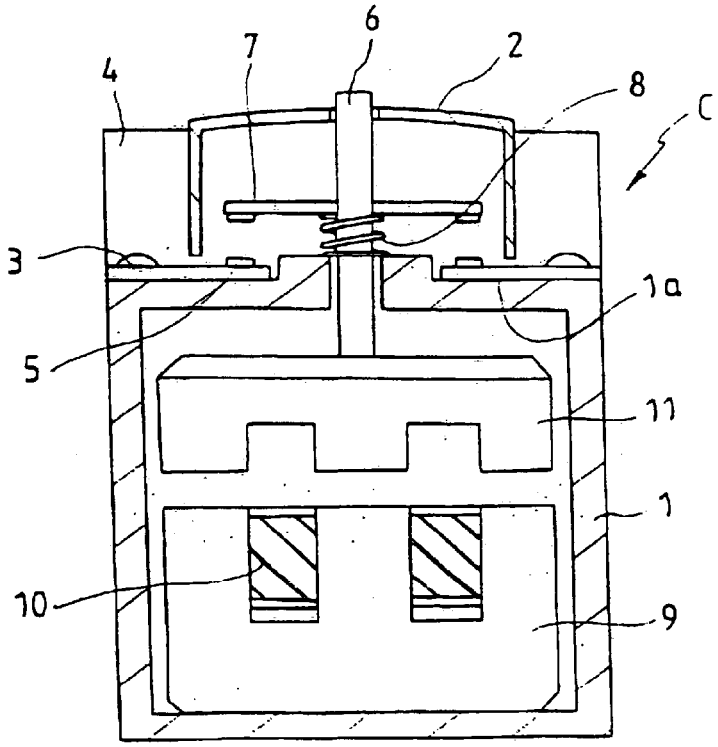
Figure 2:
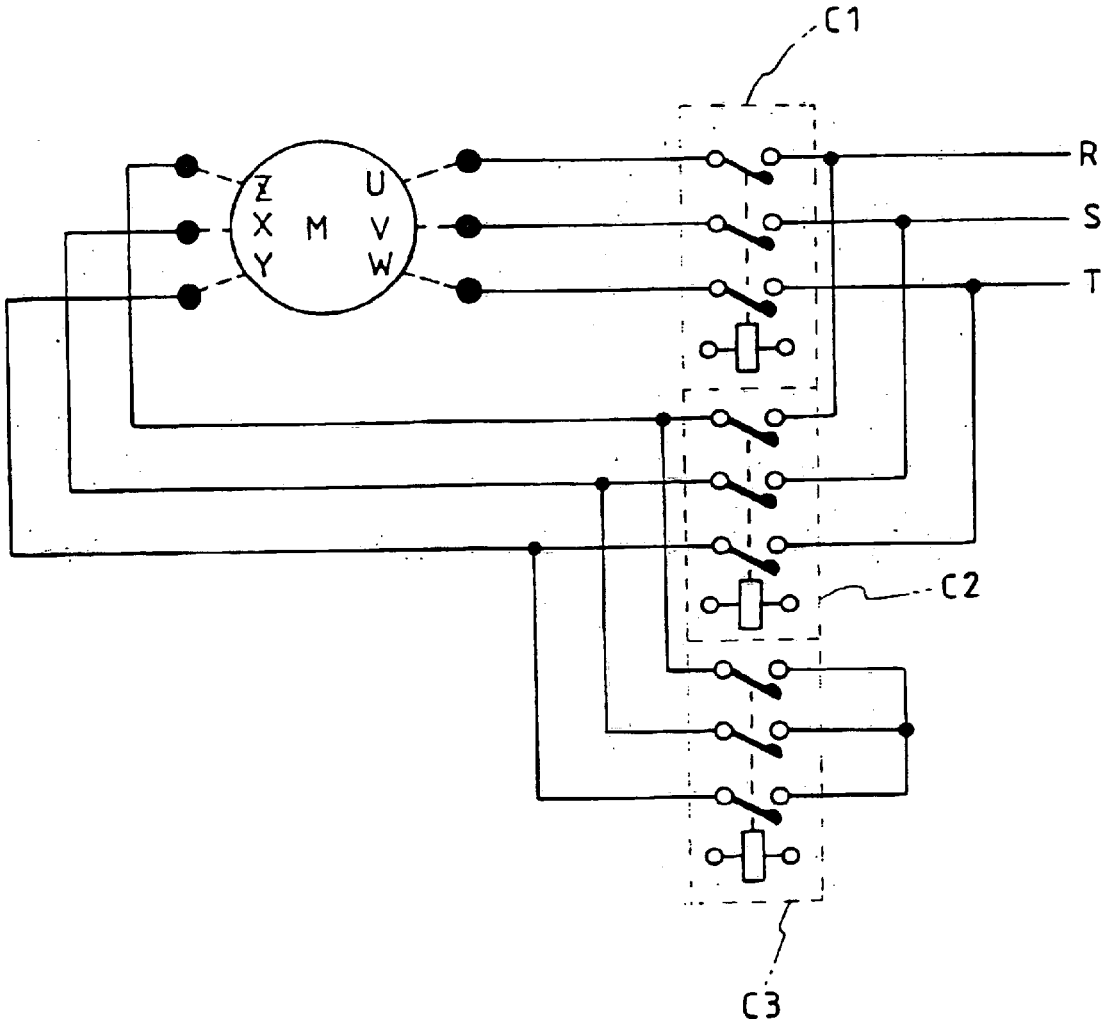
Figure 3A:
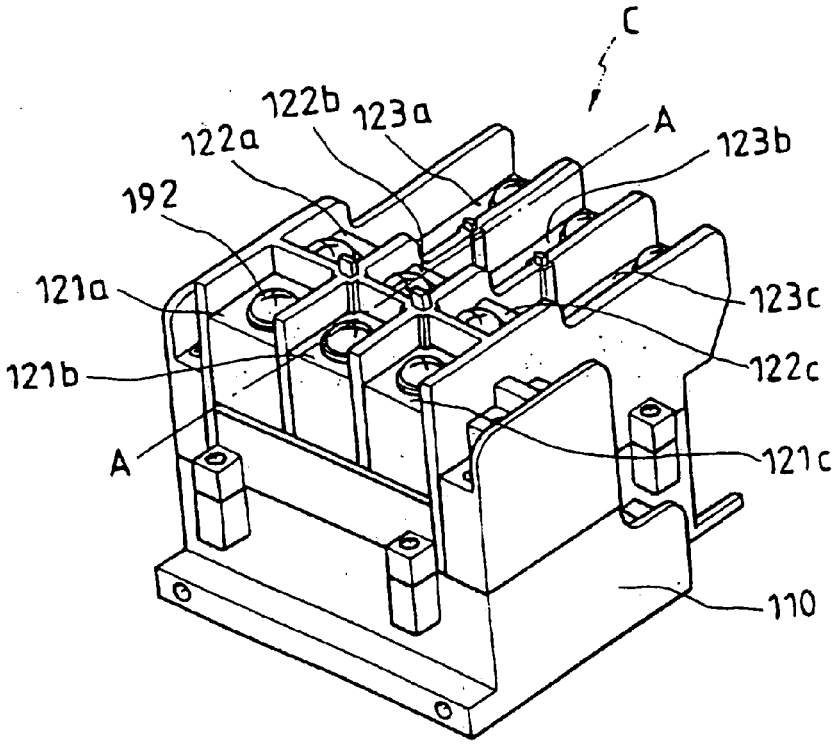
Figure 3B:
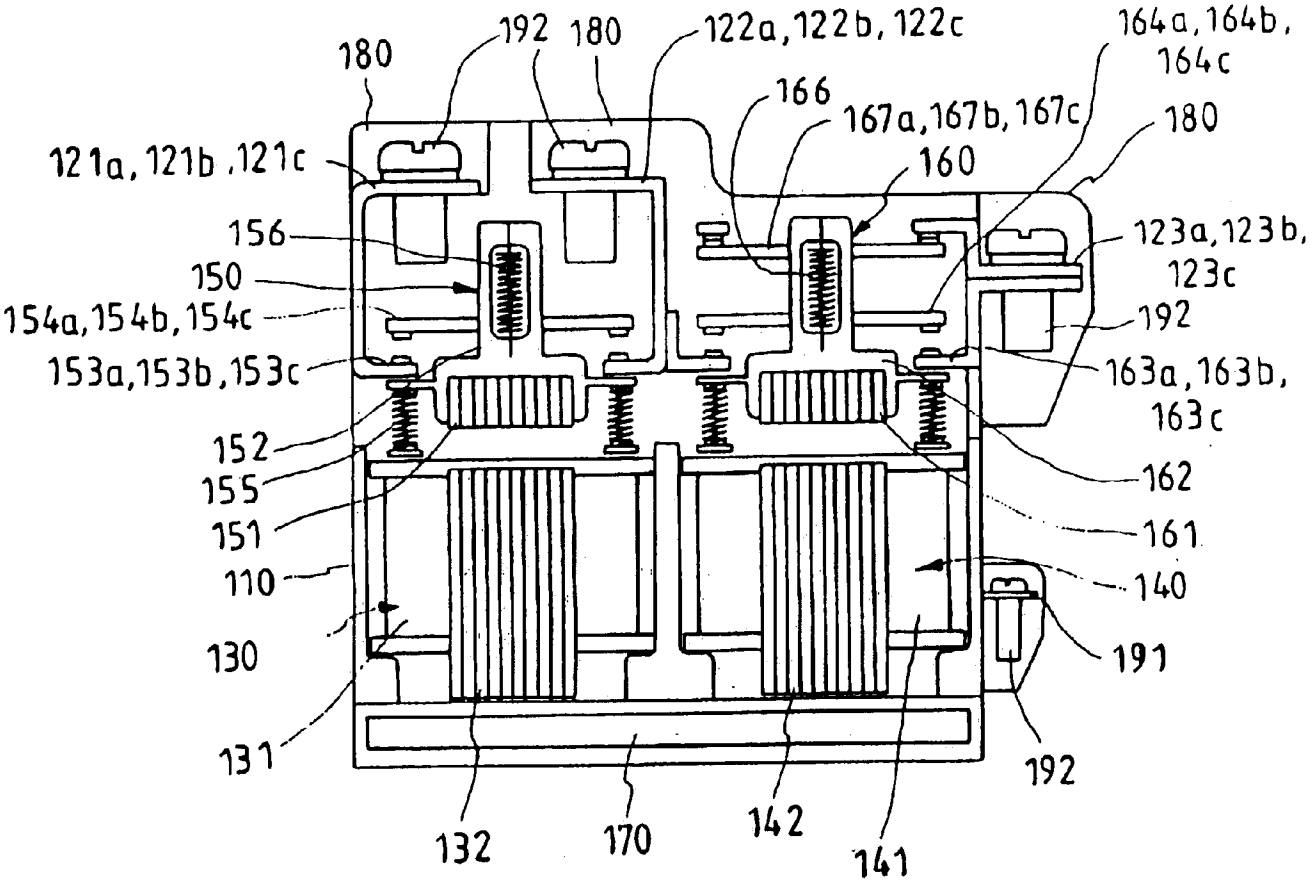
Figure 4:
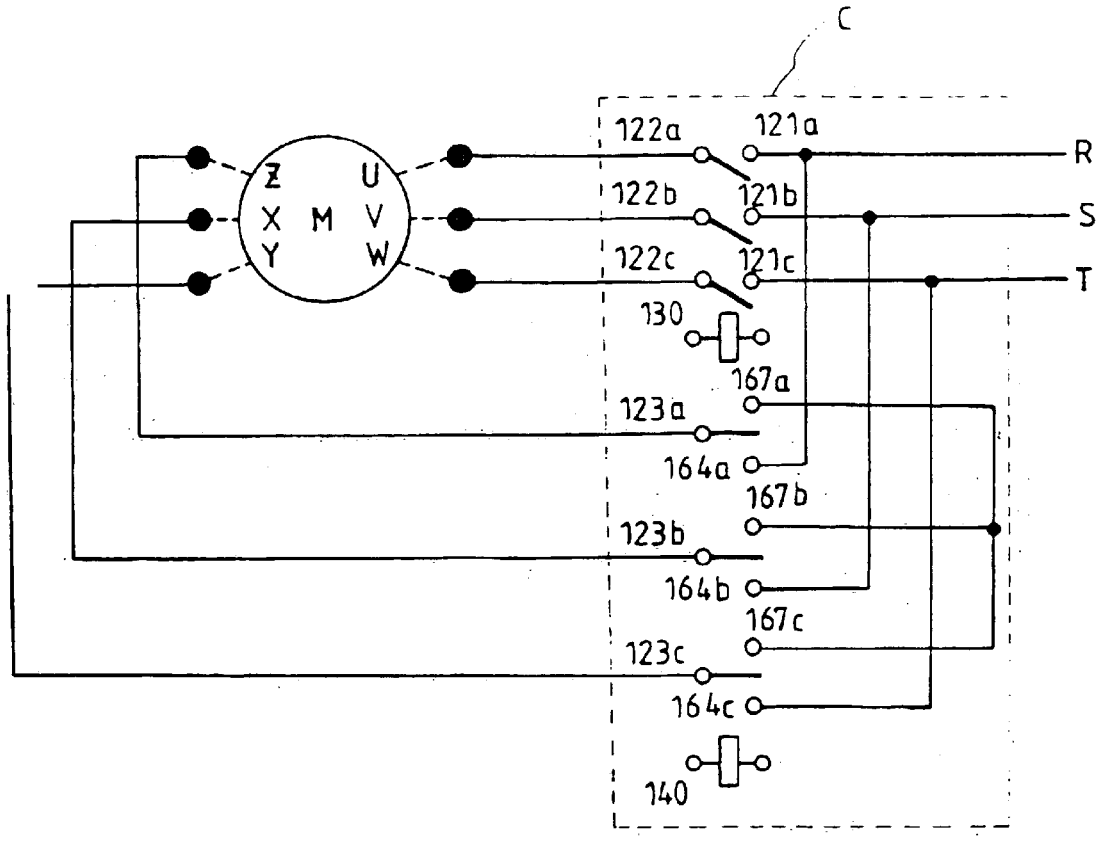

FIGS. 3*a*, 3*b* and 4 illustrate an electromagnetic switch device according to the present invention and a star-delta starter using the electromagnetic switch device, respectively. FIG. 3*a* is a perspective view of the electromagnetic switch device, and FIG. 3*b* is a cross-sectional view taken-along the line A—A of FIG. 3*a*. FIG. 4 is an equivalent circuit diagram of the star-delta starter using the electromagnetic switch device according to the present invention.

As shown in FIGS. 3*a* and 3*b*, the electromagnetic switch device of the present invention, which is denoted by the reference character C, includes a body 110, and three power terminals 121*a*, 121*b*, and 121*c* arranged at one side of the body 110 and respectively connected to three-phase power lines R, S, and T. The power terminals 121*a*, 121*b*, and 121*c* are insulated from one another. The electromagnetic switch device also includes three main starting terminals 122*a*, 122*b*, and 122*c*arranged at the other side of the body 110 and respectively connected to one-side terminals u, v, and w of a three-phase electric motor M. The main starting terminals 122*a*, 122*b*, and 122*c* are insulated from one another. Three star-delta terminals 123*a*, 123*b*, and 123*c* are arranged at the other side of the body 110 outside the main starting terminals 122*a* to 122*c*. The star-delta terminals 123*a*, 123*b*, and 123*c* are connected to the other-side ends Z, X, and Y of the three-phase electric motor M, respectively. The star-delta terminals 123*a*, 123*b*, and 123*c* are insulated from one another.

An electromagnet 130 for a main circuit and an electromagnet 140 for star-delta connections are disposed at a lower portion of the body 110 in such a fashion that they are laterally aligned with each other while being insulated from each other. The electromagnet 130 includes a fixed core 131 and a coil 132 whereas the electromagnet 140 includes a fixed core 141 and a coil 142.

The electromagnetic switch device also includes a main circuit switching unit 150 arranged above the main circuit-end electromagnet 130 in the interior of the body 110. The main circuit switching unit 150 serves to selectively connect the main starting terminals 122*a*, 122*b*, and 122*c* to respective power terminals 121*a*, 121*b*, and 121*c* in accordance with a magnetization of the main circuit-end electromagnet 130.

The main circuit switching unit 150 includes a main circuit-end moving core 151 and a main circuit-end vertical moving member 152 integrally coupled together and arranged above the main circuit-end electromagnet 130 near the main circuit-end electromagnet 130. The moving core 151 and vertical moving member 152 are adapted to be moved together in accordance with a magnetization of the electromagnet 130. The main circuit switching unit 150 also includes three pairs of main circuit-end fixed contacts 153*a*, 153*b*, and 153*c* arranged at desired positions within a vertical movement zone of the main circuit-end vertical moving member 152 in such a fashion that the fixed contacts of each fixed contact pair are disposed at opposite sides of the vertical moving member 152, respectively. The fixed contacts 153*a*, 153*b*, and 153*c* arranged at one side of the vertical moving member 152 are connected to the power terminals 121*a*, 121*b*, and 121*c*, respectively, while being insulated from one another. The fixed contacts 153*a*, 153*b*, and 153*c* arranged at the other side of the vertical moving member 152 are connected to the main starting terminals 122*a*, 122*b*, and 122*c*, respectively, while being insulated from one another. Three pairs of moving contacts 154*a*, 154*b*, and 154*c* are mounted to the main circuit-end vertical moving member 152 in such a fashion that the moving contacts of each moving contact pair are disposed at opposite sides of the vertical moving member 152, respectively. The moving contacts 154*a*, 154*b*, and 154*c* arranged at one side of the vertical moving member 152 are insulated from one another. In similar, the moving contacts 154*a*, 154*b*, and 154*c* arranged at the other side of the vertical moving member 152 are insulated from one another. The moving contacts 154*a*, 154*b*, and 154*c* are vertically moved in accordance with a vertical movement of the vertical moving member 152, so that they selectively come into contact with respective associated ones of the fixed contacts 153*a*, 153*b*, and 153*c*, thereby causing the power terminal-end fixed contacts 153*a*, 153*b*, and 153*c* to be selectively connected to the starting terminal-end fixed contacts 153*a*, 153*b*, and 153*c*.

Return springs 155 are arranged around the moving core 151 between the upper surface of the main circuit-end electromagnet 130 and the lower surface of the main circuit-end vertical moving member 152 in order to provide a return force for returning the vertical moving member 152 to its original position at which the moving contacts 154*a*, 154*b*, and 154*c* are separated from respective associated ones of the fixed contacts 153*a*, 153*b*, and 153*c*. An arc prevention spring 156 is arranged in the main circuit-end vertical moving member 152 in order to always urge the moving contacts 154*a*, 154*b*, and 154*c* toward the fixed contacts 153*a*, 153*b*, and 153*c*, thereby increasing the contact force of the moving contacts 154*a*, 154*b*, and 154*c* when the moving contacts 154*a*, 154*b*, and 154*c* come into contact with the fixed contacts 153*a*, 153*b*, and 153*c*, so as to suppress generation of arc at those contacts.

The electromagnetic switch device further includes a star-delta connection switching unit 160 arranged above the star-delta connection-end electromagnet 140 in the interior of the body 110. The star-delta connection switching unit 160 serves to selectively connect the star-delta terminals 123*a*, 123*b*, 123*c*to one another or to respective main starting terminals 122*a*, 122*b*, and 122*c* in accordance with a magnetization of the star-delta connection-end electromagnet 140.

The star-delta connection switching unit 160 includes a star-delta connection-end moving core 161 and a star-delta connection-end vertical moving member 162 integrally coupled together and arranged above the star-delta connection-end electromagnet 140 near the star-delta connection-end electromagnet 140. The moving core 161 and vertical, moving member 162 are adapted to be moved together in accordance with a magnetization of the electromagnet 140. The star-delta connection switching unit 160 also includes three pairs of fixed contacts 163*a*, 163*b*, and 163*c* for star-delta connection arranged at desired positions within a vertical movement zone of the star-delta connection-end vertical moving member 162 in such a fashion that the fixed contacts of each fixed contact pair are disposed at opposite sides of the vertical moving member 162, respectively. The fixed contacts 163*a*, 163*b*, and 163(0 163*c* . ranged at one side of the vertical moving member 162 are connected to the main starting terminals 122*a*, 122*b*, and 122*c*, respectively, while being insulated from one another. The fixed contacts 163*a*, 163*b*, and 163*c* arranged at the other side of the vertical moving member 162 are connected to the star-delta terminals 123*a*, 123*b*, and 123*c*, respectively, while being insulated from one another. Three pairs of moving contacts 164*a*, 164*b*, and 164*c* for delta connection are mounted to the star-delta connection-end vertical moving member 162 in such a fashion that the moving contacts of each moving contact pair are disposed at opposite sides of the vertical moving member 162, respectively. The moving contacts 164*a*, 164*b*, and 164*c* arranged at one side of the vertical moving member 162 are insulated from one another. In similar, the moving contacts 164*a*, 164*b*, and 164*c* arranged at the other side of the vertical moving member 162 are insulated from one another. The moving contacts 164*a*, 164*b*, and 164*c* are vertically moved in accordance with a vertical movement of the vertical moving member 162, so that they selectively come into contact with respective associated ones of the fixed contacts 163*a*, 163*b*, and 163*c*, thereby causing the star-delta connection-end fixed contacts 163*a*, 163*b*, and 163*c* to be selectively connected to the starting terminal-end fixed contacts 163*a*, 163*b*, and 163*c*.

Three moving contacts 167*a*, 167*b*, and 167*c* for star connection are also mounted to the star-delta connection-end vertical moving member 162 above the delta connection-end moving contacts 164*a*, 164*b*, and 164*c* near the fixed contacts 163*a*, 163*b*, and 163*c* connected to th the r-delta terminals 123*a*, 123*b*, and 123*c*. The star connection-end moving contacts 167*a*, 167*b*, and 167*c* are short-circuited together. The moving contacts 167*a*, 167*b*, and 167*c* are vertically moved in accordance with a vertical movement of the vertical moving member 162, so that they selectively come into contact with respective associated ones of the fixed contacts 163*a*, 163*b*, and 163*c*, thereby causing the fixed contacts 163*a*, 163*b*, and 163*c* to be selectively connected together. The star connection by the star connection-end moving contacts 167*a*, 167*b*, and 167*c* and the delta connection by the delta connection-end moving contacts 164*a*, 164*b* and 164*c* are achieved in an alternating fashion. For example, the star connection by the star connection-end moving contacts 167*a*, 167*b*, and 167*c* is achieved when the delta connection by the delta connection-end moving contacts 164*a*, 164*b* and 164*c* is released.

Return springs 165 are arranged around the star-delta connection-end moving core 161 between the upper surface of the star-delta connection-end electromagnet 140 and the lower surface of the star-delta connection-end vertical moving member 162 in order to provide a return force for returning the vertical moving member 162 to its original position at which the delta connection-end moving contacts 164*a*, 164*b*, and 164*c* are separated from respective associated ones of the fixed contacts 163*a*, 163*b*, and 163*c*. An arc prevention spring 166 is arranged in the star-delta connection-end vertical moving member 162 in order to always urge the delta connection-end moving contacts 164*a*, 164*b*, and 164*c* and the star connection-end moving contacts 167*a*, 167*b*, and 167*c* toward respective corresponding portions of the fixed contacts 163*a*, 163*b*, and 163*c*, thereby increasing the contact force of the delta connection-end moving contacts 164*a*, 164*b*, and 164*c* or the star connection-end moving contacts 167*a*, 167*b*, and 167*c* when the delta connection-end moving contacts 164*a*, 164*b*, and 164*c* or the star connection-end moving contacts 167*a*, 167*b*, and 167*c* come into contact with the fixed contacts 153*a*, 153*b*, and 153*c*, so as to suppress generation of arc at those contacts.

A timer 170 is arranged beneath the main circuit-end electromagnet 130 and star-delta connection-end electromagnet 140 in the interior of the body 110. The timer 170 serves to count an activation time of the main circuit-end electromagnet 130, thereby determining a point of time when the star-delta connection-end electromagnet 140 is to be activated. Isolating plates 180 are also arranged to isolate adjacent ones of the power terminals 121*a*, 121*b*, and 121*c*, adjacent ones of the main starting terminals 122*a*, 122*b*, and 122*c*, and adjacent ones of the star-delta terminals 123*a*, 123*b*, and 123*c*, respectively.

In the drawings, the reference: numeral 191 denotes terminals to which power lines are coupled in order to supply current to the coils 132 and 142. The reference numeral 192 denotes bolts respectively coupled to the terminals 191 in order to provide an easy connection of the power lines to the terminals 191.

The electromagnetic switch device C for star-delta connections having the above mentioned configuration operates in a connection state, as shown in the equivalent circuit diagram of FIG. 4, in such a fashion that it establishes a star connection, when it is desired to start up the electric motor M, in order to achieve a start-up of the electric motor M using starting current and starting torque reduced to a ⅓ level while switching the connection of the electric motor M to a delta connection after completion of the start-up of the electric motor M. For the best understanding of the present invention, elements of FIG. 4 respectively corresponding to those in FIGS. 3*a* and 3*b* are denoted by the same reference numerals.

Now, the operation of the electromagnetic switch device C for star-delta connections according to the present invention will be described.

When current flows through the coil 132 of the main circuit-end electromagnet 130, which is constructed by the fixed core 131 and the coil 132, upon starting the three-phase electric motor M, the electromagnet 130 is magnetized by virtue of the current. Simultaneously with the magnetization of the electromagnet 130, the timer 170 begins to count the activation time of the electromagnet 130.

As the electromagnet 130 is activated, it generates a magnetm/etic . rce greater than the resilience of the return spring 155, so that the moving core 151 and vertical moving member 152 are downwardly moved. At the same time, the main circuit-end moving contacts 154*a*, 154*b*, and 154*c* are downwardly moved, so that they come into contact with the main circuit-end fixed contacts 153*a*, 153*b*, and 153*c*, respectively.

In such an initial state, the star-delta connection-end electromagnet 140 is maintained under a non-magnetization condition, that is, a condition in which no current flows through the coil 142. Accordingly, the star-delta connection-end moving coil 161 and star-delta connection-end vertical moving member 162 are maintained in a state in which they are spaced away from the coil 142 by virtue of the resilience of the return spring 165. In this state, the delta connection-end moving contacts 164*a*, 164*b*, and 164*c* are separated from the associated fixed contacts 163*a*, 163*b*, and 163*c* whereas the star connection-end moving contacts 167*a*, 167*b*, and 167*c* are in contact with the associated fixed contacts 163*a*, 163*b*, and-163*c*, that is, in a state short-circuited to the associated fixed contacts 163*a*, 163*b*, and 163*c*.

Accordingly, the three-phase electric motor M is in a star connection state, so that it is started up by electric power supplied via the three-phase power lines R, S, and T respectively connected to the power terminal 121*a*, 121*b*, and 121*c*.

After a predetermined period of time elapses, the timer 170 operates to allow current to flow through the coil 142 of the star-delta connection-end electromagnet 140. By virtue of the current, the stat-delta connection-end electromagnet 140 is magnetized.

As the electromagnet 130 is activated, it generates a magnetic force greater than the resilience of the return spring 165, so that the moving core 161 and vertical moving member 162 are downwardly moved.

At the same time, the star connection-end moving contacts 167*a*, 167*b*, and 167*c* are downwardly moved, so that they are separated from the associated fixed contacts 163*a*, 163*b*, and 163*c*, respectively. Also, the delta connection-end moving contacts 164*a*, 164*b*, and 164*c* are downwardly moved, so that they come into contact with the associated fixed contacts 163*a*, 163*b*, and 163*c*, respectively.

As a result, the main starting terminals 122*a*, 122*b*, and 122*c* are connected with the star-delta terminals 123*a*, 123*b*, and 123*c*, respectively, so that the three-phase electric motor M is switched to a delta connection state in which it is driven at a full speed.

INDUSTRIAL APPLICABILITY

As apparent from the above description, the present invention provides an electromagnetic switch device for star-delta connections which includes two electromagnets arranged in its body and two switchingng us operating in accordance with respective magnetization states of the electromagnets in order to selectively establish a star connection or a delta connection for a three-phase electric motor. The electromagnetic switch device of the present invention can reduce installation costs and an occupation space when it is applied to a star-delta starter. In addition, there is no unnecessary wiring. Accordingly, it is possible to reduce erroneous connections and erroneous operations.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An electromagnetic switch device for star-delta connections comprising:

a body;

first through third power terminals arranged at one side portion of the body on an upper surface of the body and respectively connected to three-phase power lines;

first through third main starting terminals arranged at an intermediate portion of the body on the upper surface of the body and respectively connected to one-side terminals of a three-phase electric motor;

first through third star-delta terminals arranged at the other side portion of the body on the upper surface of the body and connected to the other-side terminals of the three-phase electric motor, respectively;

a star connection plate set on the upper surface of the body and adapted to connect the first through third star-delta terminals to a star circuit;

first through third contacts set beneath the star connection plate and adapted to connect the first through third star-delta terminals to a delta circuit;

a timer assembled to the body at a bottom of the body while being integral with the body, the timer serving to control a start-up time for the three-phase motor;

an electromagnet for a main circuit and an electromagnet for star-delta connections each including a fixed core and a coil assembled in the interior of the body, each of the electromagnets being selectively magnetized in accordance with a cooperation of the fixed core and coil thereof;

a main circuit switching unit assembled to an upper portion of the body at one side of the body so that it is integral with the body, the main circuit switching unit serving to selectively connect the first through third power terminals with the first through third main terminals, respectively, in accordance with the magnetization of the main circuit-end electromagnet; and a star-delta connection switching unit assembled to the upper portion of the body at the other side of the body so that it is integral with the body, the star-delta connection switching unit serving to connect the star connection plate to the first through third star-delta terminals in accordance with the magnetization of the main circuit-end electromagnet under a condition in which the first through third power terminals are connected with the first through third main terminals, thereby allowing the three-phase motor to be start up in a star connection state, the star-delta connection switching unit also serving to connect the first through third delta connection contacts to the first through third star-delta terminals when the star-delta connection-end electromagnet is magnetized in accordance with an operation of the timer after the start-up of the three-phase motor, thereby causing the three-phase motor to be driven in a delta connection state.

2. The electromagnetic switch device according to claim 1, wherein the star-delta switching unit comprises:

a star-delta connection-end moving core adapted to move vertically in accordance with a magnetization of the star-delta connection-end electromagnet;

a star-delta connectiona connection-end vermoving member integrally coupled to the star-delta connection-end moving core and adapted to move vertically along with the star-delta connection-end moving core;

first through third star connection-end moving members adapted to move upwardly along with the star-delta connection-end vertical moving member in accordance with a magnetization of the main circuit-end electromagnet under a condition in which the first through third main terminals are connected to the first through third power thermals, so that they are connected to the first through third star-delta terminals while being connected to the star connection plate, thereby allowing the three-phase electric motor to be started up in the star connection state; and first through third delta connection-end moving members adapted to move downwardly along with the star-delta connection-end vertical moving member when the star-delta connection-end electromagnet is magnetized after a time set by the timer elapses, following the start-up of the three-phase electric motor in the star connection state, so that they are connected to the first through third star-delta terminals while being connected to the first through third delta connection contacts, thereby causing the three-phase electric motor to be driven in the delta connection state.

3. The electromagnetic switch device according to claim 1, wherein the star-delta switching unit further comprises:

star-delta connection-end compression coil springs adapted to always urge the star-delta connection-end vertical moving member to move upwardly, thereby allowing the three-phase electric motor to be started up in the star connection state, the star-delta connection coefficient lower than a magnetic force of the star-delta connection-end electromagnet to allow the star-delta connection-end vertical moving member to move downwardly against the urging force of the star-delta connection-end compression coil springs when the star-delta connection-end electromagnet is -magnetized, thereby causing the three-phase electric motor to be driven in the delta connection state, the star-delta connection-end compression coil springs being arranged in pair so that those of each pair are disposed at opposite sides of other star-delta connection-end electromagnet, respectively; and star-delta connection-end damping springs for damping impact generated when the first through third star connection-end moving members abruptly contact associated contact portions -as the star-delta connection-end vertical moving member moves upwardly by virtue of the urging force of the star-delta connection-end compression coil springs while damping impact generated when the first through third star connection-end moving members abruptly contact associated fixed contacts as the star-delta connection-end vertical moving member moves upwardly by virtue of the magnetic force of the star-delta connection-end electromagnet, force of the star-delta connection-end electromagnet, respectively, the star-delta connection-end damping springs being arranged in the form of a plurality of sets each including three star-delta connection-end damping springs.

* * * * *